United States Patent [19]

Thordarson et al.

[11] Patent Number: 4,627,351

[45] Date of Patent: Dec. 9, 1986

[54] FUSE FOR PROJECTILES

[75] Inventors: Gunnar G. Thordarson; Sven O. Bidö, both of Järfälla, Sweden

[73] Assignee: U.S. Philips Corporation, New York, N.Y.

[21] Appl. No.: 646,731

[22] Filed: Sep. 4, 1984

[30] Foreign Application Priority Data

Sep. 8, 1983 [SE] Sweden ..... 8304814

[51] Int. Cl.[4] ..... F42C 13/02

[52] U.S. Cl. ..... 102/213; 102/214

[58] Field of Search ..... 102/213, 214

[56] References Cited

U.S. PATENT DOCUMENTS

| | | | |
|---|---|---|---|
| 3,046,892 | 7/1962 | Cosse et al. | 102/213 |
| 3,902,172 | 8/1975 | Weiss et al. | 102/213 |
| 3,924,233 | 12/1975 | Nastronero et al. | 102/213 |
| 4,022,132 | 5/1977 | Blomqvist et al. | 102/213 |
| 4,160,415 | 7/1979 | Cole | 102/214 |
| 4,193,072 | 3/1980 | McKusick | 102/213 |
| 4,245,560 | 1/1981 | Rambauske | 102/213 |

FOREIGN PATENT DOCUMENTS

| | | | |
|---|---|---|---|
| 2052021 | 1/1981 | United Kingdom | 102/213 |

*Primary Examiner*—Charles T. Jordan

*Attorney, Agent, or Firm*—Thomas A. Briody; William J. Streeter; Leroy Eason

[57] ABSTRACT

The invention relates to a fuse for rotating projectiles having directive explosive force, whereby is meant that the projectile has effect in one direction only, which direction does not coincide with the length axis of the projectile, and substantially no effect in other directions. The fuse according to the invention comprises two sensors. A first sensor with a narrow sensitivity lobe in a direction not coinciding with the length direction of the projectile, suitably the same direction as the direction for maximal explosive force, produces a pulse signal each time its sensitivity lobe is directed towards a target, and a second sensor monitors the distance to the target. The pulse signal obtained from the first sensor is used to initiate burst at a moment when the direction for maximal explosive force coincides with the direction to the target, provided that the second sensor indicates that the projectile has entered a given distance zone from the target.

7 Claims, 5 Drawing Figures

24
23
MIXER
25
26
27
28
AMPLITUDE DETECTOR
A
30
THRESHOLD CIRCUIT
29
S
FF
R
C
38
&
D
B
21
TRANSMITTER
22
FREQ. MODULATOR
PHASE LOCKED LOOP
32
34
35
36
VCO
37
÷N
COUNTER
R
÷M
COUNTER
33
31
IGNITION CIRCUIT
44
G
43
COUNTER
39
&
F
E
40
IR SENSOR
41
42
THRESHOLD CIRCUIT

FUSE FOR PROJECTILES

BACKGROUND OF THE INVENTION

1. Field of the Invention

The invention relates to a device, a so-called fuse, for initiating burst of a rotating projectile having directive explosive force when the projectile is close to a target.

2. Description of the Related Art

Proximity fuses of many types are known which initiate burst at a certain distance from a target. These fuses are not suitable for use with projectiles having directive explosive force, their function not being dependent on whether the projectile rotates or not.

SUMMARY OF THE INVENTION

The object of the invention is to construct a fuse for a rotating projectile having directive explosive force, in which the rotation in combination with the directive explosive force is utilized for achieving a more reliable and more effective hit of a target as compared with what is possible with known proximity fuses. By the expression "a projectile having directive explosive force" is herein to be understood a projectile having substantially all its effect in a certain direction, which does not coincide with the length axis of the projectile, and substantially no effect in other directions.

According to the invention this is achieved in that the fuse has two sensors for sensing a target. The first sensor has a narrow sensitivity lobe directed in a direction which does not coincide with the length axis of the projectile, is directed obliquely forward at a known angle with respect to the direction for maximal explosive force, and delivers a pulse shaped signal each time it is directed towards the target during the rotation of the projectile. The second sensor is adapted to monitor the distance to the target and to deliver a signal indicating that the projectile has entered a given distance zone from the target. The signal from the first sensor is fed to an ignition circuit for initiating burst at a moment when the direction for maximal explosive force coincides with the direction to the target, provided that the second sensor indicates that the projectile has entered the given distance zone.

In the fuse according to the invention the distance information is not utilized for initiating burst but only as a coarse indication that the projectile has passed a given distance limit from the target. Burst is then initated by means of the directive signal obtained from the sensor with the narrow sensitivity lobe. Thus the fuse according to the invention is not a proximity fuse in its normal meaning but can rather be regarded as a variant of a final guidance system, since although the projectile is not actually guided the explosive force in the final phase of its path is automatically directed to the target by utilization of the rotation of the projectile.

A preferred embodiment of the device according to the invention is characterized in that the second sensor has a limited sensitivity lobe in a direction which does not coincide with the length axis of the projectile and delivers a pulse-shaped signal as a result of the rotation of the projectile, the sensitivity lobe of the second sensor forming a known angle with the lobe of the first sensor, means being furthermore arranged for comparing the phase of the pulse signal of the first sensor with the phase of the pulse signal of the second sensor so that only pulse signals from the first sensor in given phases relative to the pulse signals of the second sensor can initiate burst, while pulses in other phases are blocked.

The sensor is then utilized not only for indicating passage of a given distance limit into the given distance zone from the target but also to deliver coarse direction information about the instantaneous position of the narrow sensitivity lobe and thereby about the direction of maximal explosive force, which information is utilized to block all pulses from the first sensor, which appear at such moments that they cannot originate from a real target. Thereby immunity to disturbance is essentially improved. If for example a ground target is to be engaged then the second sensor only has to measure the distance to ground but does not need to be so sensitive that it can discover targets on the ground. The directive information inherent in the pulse-shaped output signal of the second sensor will then be immune to disturbance and can be utilized for blocking all pulses from the first sensor which appear at erroneous moments.

The signal processing in such a device is very simple and can in principle be realized by means of an AND-circuit, one input of which is supplied with the pulse signal of the first sensor and a second input supplied with the pulse signal of the second sensor, the output pulse signal from the AND-circuit being fed to the ignition circuit. When the angle between the sensitivity directions of the two sensors is not zero, a delay circuit in series with one of the inputs of the AND-circuit delays or displaces the phase of the pulse signal applied thereto by a time corresponding to the known angle between the sensitivity directions of the two sensors.

The narrow sensitivity lobe may have substantially the same direction as the direction for maximal explosive force of the projectile. This has the advantage that the pulse signal from the first sensor can be used directly for initiating burst at the moment the sensor sees the target. Alternatively the narrow sensitivity lobe may be somewhat angularly displaced in relation to the direction for maximal explosive force in order to compensate for the time elapsing from initiating of the burst signal until the ignition circuit actually causes burst.

In order to further improve the accuracy of fire counter means may be provided for counting the number of target pulses from the sensor with the narrow sensitivity lobe beginning after the moment when the projectile has entered the given distance zone and initiating burst only after a given number of such target pulses, for example two, have occurred.

The sensor with the narrow sensitivity lobe can be an infrared ("IR")-detector. By means of simple optics such a detector can establish any desired lobe angle.

The second sensor for sensing when the projectile has passed a given threshold distance from the target can be a conventional altimeter of electromagnetic type, a radar proximity fuse or the like, which continuously measures the distance to the target. Alternatively it may consist of a measuring circuit which only indicates the passage of the given threshold distance.

In an advantageous embodiment of the device according to the invention the two sensors are arranged diametrically opposite each other in the fuse, so that the pulse-shaped signals from the two sensors will be 180° phase displaced relative to each other. Thereby the mutual interference between the two sensors will be reduced to a minimum and the fuse will have a compact structure.

U.S. Pat. No. 3,902,172 describes a fuse in which an IR-detector is combined with a conventional radio frequency proximity fuse. However the IR-detector is only utilized to enable the proximity fuse when the IR-detector has detected thermal energy originating from an expected target. Before the enabling signal from the IR-detector the proximity fuse is inactive. After such enabling the proximity fuse operates in known manner, without further help from the IR-detector, for triggering the ignition circuit at a given distance from the target. The purpose of the combination of IR-detector and conventional proximity fuse in this device is to reduce the risk of erroneous triggering of the ignition circuit due to false targets or decoys and does not concern controlling ignition so as to take advantage of the maximum direction of the explosive burst of a rotating projectile.

BRIEF DESCRIPTION OF THE DRAWINGS

The invention is illustrated in the accompanying drawings, in which.

DESCRIPTION OF THE PREFERRED EMBODIMENTS

Figure 1:
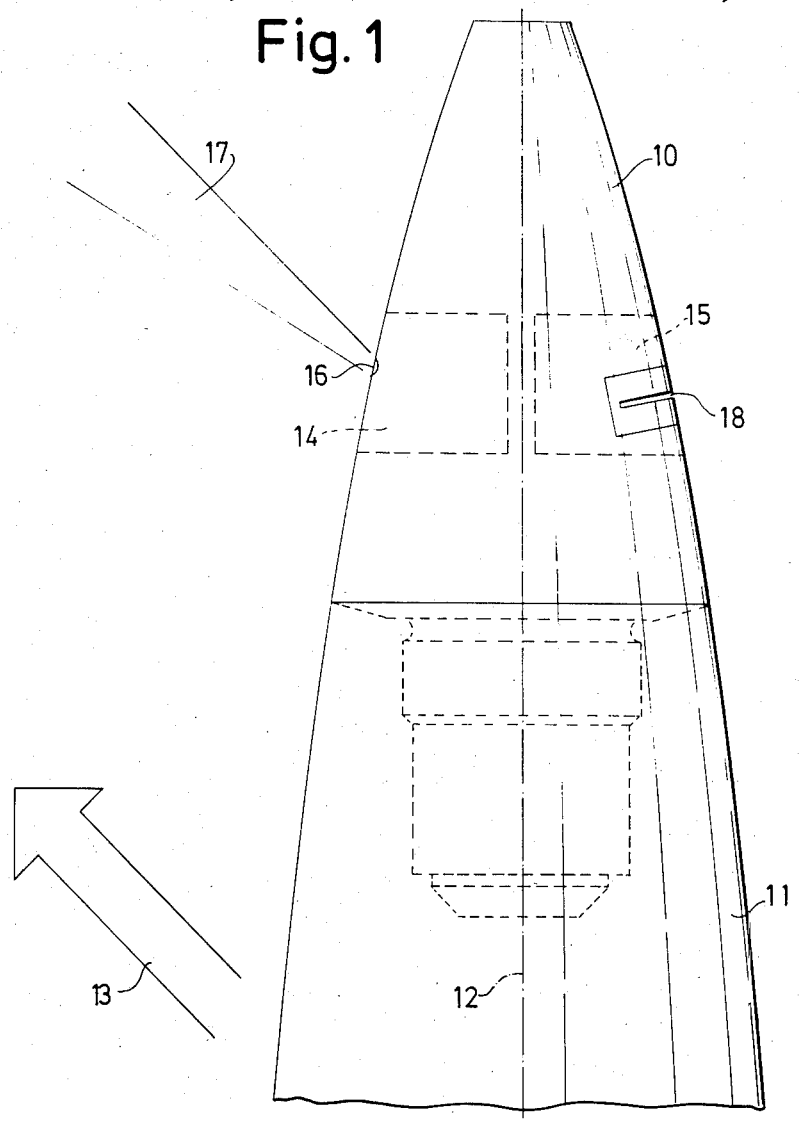
FIG. 1 shows an outline of a double-sensor fuse according to the invention.

In FIG. 1 reference numeral 10 designates a fuse which is mounted at the nose of a projectile 11. After firing a rotation about the longitudinal axis 12 is imparted to the projectile and the projectile is furthermore so constructed that at burst it only has full explosive effect in one direction. The direction for full explosive force is indicated by the arrow 13 in FIG. 1.

According to the invention the fuse 10 has two sensors, a first sensor which may take the form of an IR-detector 14 and a second sensor which may take the form of an HF-unit or so-called radar proximity fuse 15. The IR-detector 14 comprises an optical system, represented by a lens 16, so that this detector is only sensitive within a narrow directional lobe 17. This narrow lobe is directed obliquely forward and has the same direction as the direction 13 for full explosive force. The IR-detector is passive and delivers in known manner a signal which represents temperature deviations within a narrow sensing zone corresponding to the lobe, when this zone sweeps across a surface. The HF-unit is active and transmits a continuous frequency-modulated high frequency carrier via an antenna, which in FIG. 1 is illustrated as a slot antenna 18. HF-energy reflected from a target is received by the same antenna and, by combining the transmitted and received signals, a signal is obtained which represents the distance to the reflecting object. In the present case it is assumed that the distance is represented by the frequency of the combined signal. The slot antenna 18 has a wide lobe, covering substantially 180° of directions. The HF-unit with the slot antenna 18 is arranged diametrically opposite the IR-detector with the optical system 16, so that the two systems "look" in different directions. The pulse-shaped target signals obtained in the two systems and originating from one and the same target will therefore be 180° phase displaced relative to each other.

Figure 2:
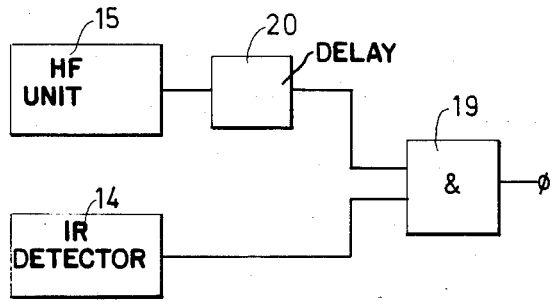
FIG. 2 shows a general block diagram of the signal processing circuit of a fuse according to FIG. 1.

FIG. 2 shows by means of a general block diagram the principle of the signal processing circuit of a double-sensor fuse according to the invention. According to FIG. 2 the output signal of the HF-unit 15 is fed to one input of an AND-gate 19 via a pulse shaper and/or delay circuit 20, while the output sigbal of the IR-detector is fed to the second input of the AND-gate. The output signal of the AND-gate 19 is fed to an ignition circuit (not shown). It is assumed that the HF-unit is so constructed that the signal at its output appears only when the projectile is within a given distance from the target. In the circuit 20 the distance-indicating signal, which due to the projectile rotation is pulse-shaped, is transformed or delayed so that the gate 19 will be enabled during the time interval when a pulse, if any, from the IR-detector arrives. In the given example the ignition signal will be initiated at the same moment as the pulse appears from the IR-detector provided that the projectile is within the predetermined distance limit. However, if the sensitivity lobe of the IR-detector is not the same as the explosive direction of the projectile, that can be compensated by introducing a delay in the signal path of the IR-pulse. As will be evident from the following description it is also possible, instead of initiating upon the appearance of the first IR-pulse after the moment when the projectile has come within the distance limit, to count the pulses from the AND-gate and to initiate burst only after a given number of such pulses, for example, two.

The operation is as follows. It is assumed that ground targets, such as tanks, are to be engaged. When the projectile approaches ground at a certain angle the IR-detector will continuously scan the ground surface for objects of different temperatures along a scanning path which, for steep impact angles, is helical. As long as the distance to the ground surface is large the pulses from the IR-dectecor, if any, will be blocked by the AND-gate 19. When the projectile comes under a given height level above ground, for example 50 meters, the HF-unit serving as the distance measuring device will produce an output signal and the gate 19 will be enabled. The pulses thereafter arriving from the IR-detector will pass the AND-gate and one of such pulses will initiate burst. The burst will therefore take place at a moment when the rotating projectile has its maximal explosive force directed toward the target.

Figure 3:
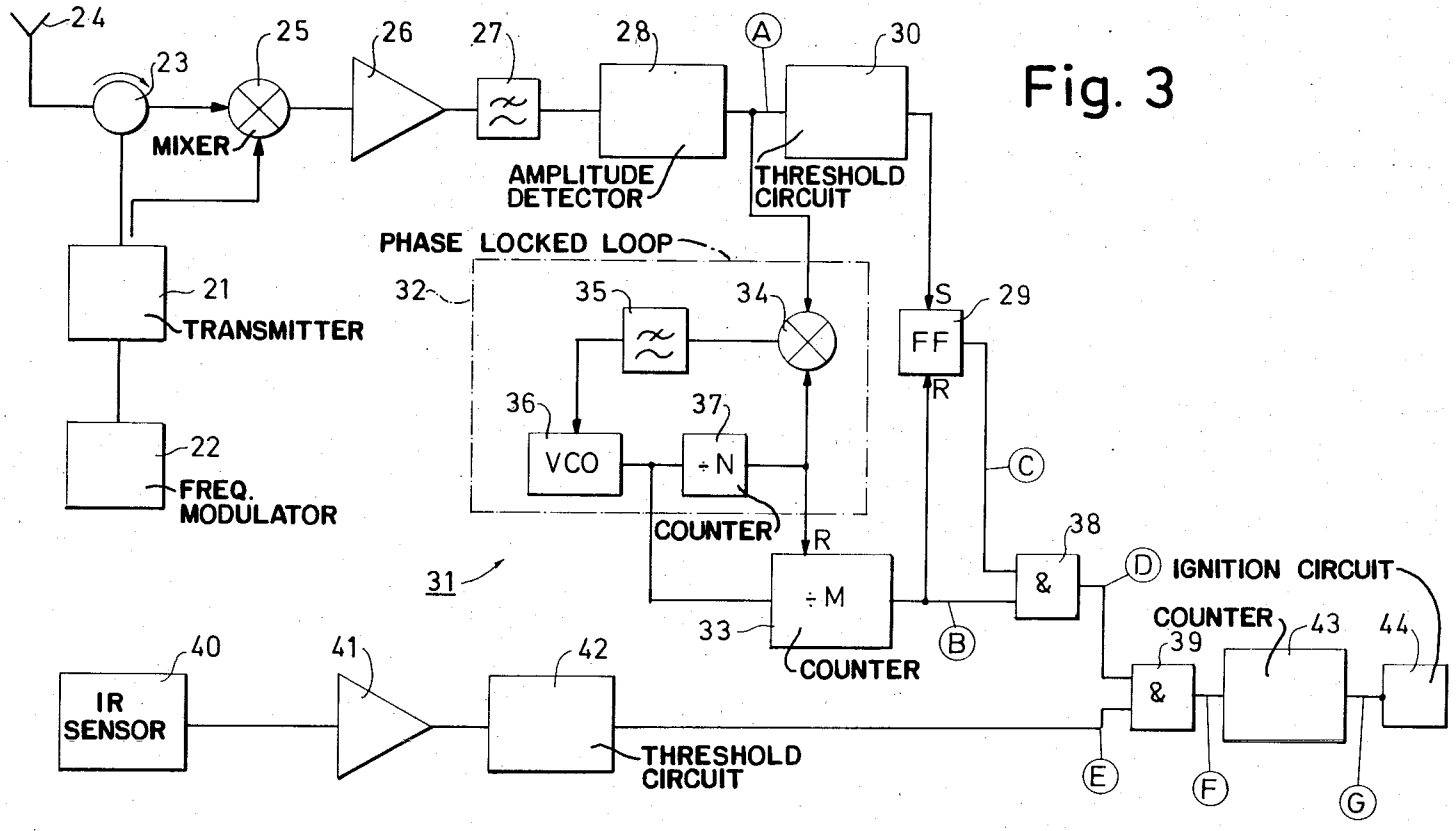
FIG. 3 shows a detailed block diagram of an embodiment of a signal processing circuit for a fuse according to FIG. 1.

FIG. 3 shows a detailed block diagram of one embodiment of the signal processing section of a double-sensor fuse according to the invention. In FIG. 3 reference number 21 is a transmitter, 22 is a modulator for periodically varying the output frequency of the transmitter 21, and 23 is a circulator leading the output signal of the transmitter to an antenna 24 and the signal received from the antenna to a mixer/detector 25 where it is combined with a signal derived from the transmitter. From the mixer is obtained a signal, the frequency of which is proportional to the distance to a reflecting target. Due to the rotation of the projectile carrying the fuse the signal from the mixer/detector 25 is pulse-shaped with a periodicity corresponding to the rotational speed of the projectile. This signal is amplified in an amplifier 26, filtered in a low pass filter 27 and detected in an amplitude detector 28. The cut-off frequency of the filter 27 is selected such that the signal can pass the filter only when the projectile has come inside a given threshold distance from the reflecting target.

Figure 4:
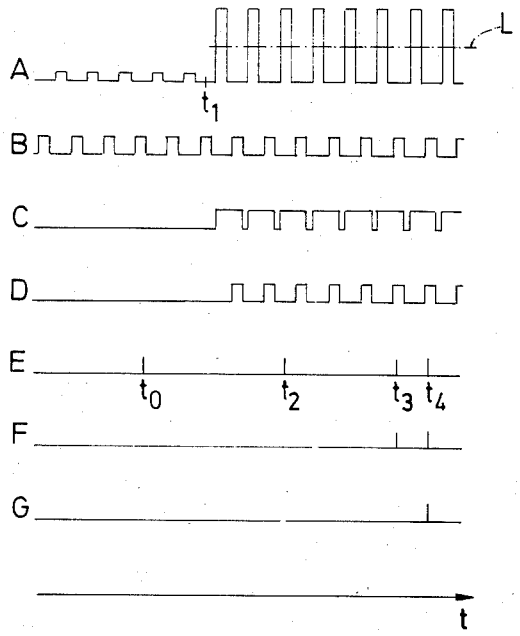
FIG. 4 shows timing diagrams illustrating the signal waveforms at some points of the circuit of FIG. 3.
Figure 5:
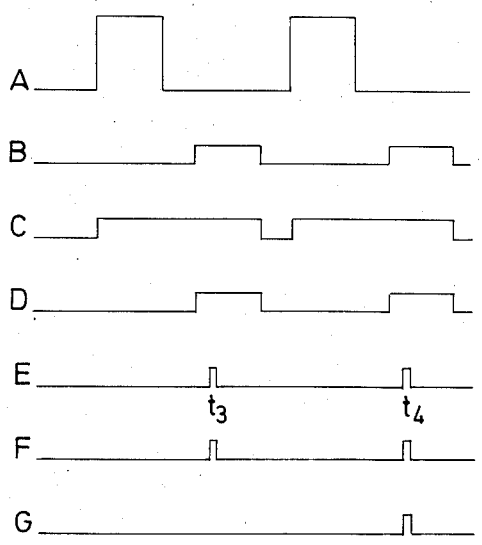
FIG. 5 shows an enlarged part of FIG. 4.

The waveform of the signal at the point A at the output of the amplitude detector 28 is shown in the first diagram A in FIG. 4, where the dotted line L indicates the threshold level in a threshold circuit which will be described in the following. At the time moment $t_1$ the projectile passes the said distance threshold. As shown, before the passage of the distance threshold, weak pulses are obtained at the output of the detector 28, while after the passage of the threshold the output pulse amplitude increases abruptly to a value exceeding the threshold and is then maintained substantially constant.

The output signal from the detector 28 is fed to the input S of a bistable flip-flop 29 via a threshold circuit 30 and also to the reset input R of the same flip-flop 29 via a delay circuit 31. This delay circuit comprises a phase-locked loop 32 and a counter 33. The phase-locked loop comprises a phase comparator 34, a low-pass filter 35, a voltage-controlled oscillator 36 and a dividing counter 37. The counter 33 is controlled from the phase-locked loop in such manner that it counts the pulses from the oscillator 36 and is periodically zeroed by the output of the dividing counter 37. The dividing counter 37 divides the frequency from the oscillator by N and delivers a pulse per revolution. The counter 33 is adapted to let each $M^{th}$ pulse after zeroing appear at its output. The phase-locked oscillator 36 is adapted to generate the delay which is necessary due to the fact that the two sensors look in different directions. The phase-locked oscillator generates a frequency which is synchronized with the rotation of the projectile, represented by the signal from the detector 28, but which has a frequency which is N times higher than the rotation frequency. The counter 33 counts the signal periods of the voltage-controlled oscillator and delivers at each $M^{th}$ period a pulse at its output, M being selected such that M/N corresponds to that part of each revolution of the projectile which separates the maximum sensitivity direction of the HF-unit from the maximum sensitivity direction of the IR-detector. The output signal from the counter 33 is shown in the diagram B in FIG. 4. From this time diagram it is evident that the output signal from the counter 33 consists of pulses which are delayed relative to the pulses from the detector 28 and the amplitudes of which are independent of whether the pulses from the detector 28 exceed the threshold level in the threshold circuit 30 or not. The front edge of the pulses from the threshold circuit 30 is used to set the flip-flop 29 while the rear edge of the pulses from the counter 33 resets the flip-flop 29. From the flip-flop 29 is obtained a signal, the shape of which is shown in the diagram C in FIG. 4. As shown, an output signal from the flip-flop 29 is obtained only if the threshold in the threshold circuit 30 has been exceeded. This signal from the flip-flop 29 is fed to one input of an AND-gate 38, while the output signal from the counter 33 is fed to the second input of the AND-gate 38. From the AND-gate 38 is obtained a pulse signal, shown in diagram D, in which the pulses coincide with the delayed pulses from counter 33 in the delay circuit 31 but which are present only if the signal from the detector 28 has exceeded the threshold of the threshold circuit 30. The appearance of output pulses from the gate 38 thus indicates that the projectile has passed the distance limit. In addition due to the delay in the circuit 31, these pulses coincide in time with target pulses from the IR-detector, if any. The time position of the output pulses from the gate 38 therefore also gives coarse information about the instantaneous direction of the IR-detector during the rotation of the projectile. The pulses from the AND-gate 38 are fed to a first input of an AND-gate 39.

The IR-sensor is represented in FIG. 3 by the block diagram 40. The pulses from the IR-sensor are amplified in an amplifier 41, suitable for the IR-sensor, and the amplified IR-pulses are compared with a threshold in a threshold circuit 42, the output signal of which is fed to a second input of the AND-gate 39. An example of the output signal from the threshold circuit 42 is shown in the diagram E in FIG. 4, while the output signal of the AND-gate 39 is shown in the diagram F in FIG. 4. This signal at the output of the AND-gate 39 is fed to the input of a counter 43 which counts the number of pulses from the AND-gate 39 and delivers an output pulse after reception of the $n^{th}$ pulse. In the example it is assumed that $n=2$. The output signal from the counter 43 is shown in the diagram G in FIG. 4. This signal is fed to an ignition circuit 44 which initiates burst.

The function is as follows:

In a time interval before the moment the projectile has reached the predetermined distance zone, represented by the cut-off frequency of the low-pass filter 27, the low-pass filter 27 starts to pass a sufficiently large signal to allow the phase-locked loop 32 to lock onto the output signal of the detector 28. Should the IR-sensor in this interval deliver a pulse, as shown at $t_0$ in the diagram E in FIG. 4, then this pulse will be blocked by the gate 39 due to the fact that this gate is not then open. When the distance threshold has been passed the gate 38 starts to deliver output pulses and enables the gate 39 periodically. If in such an interval a pulse should be obtained from the IR-sensor, which pulse appears at a wrong moment of the revolution of the projectile, as for example caused by the sun, as shown at $t_2$, then this pulse will also be blocked by the gate 39. Not until pulses in correct time position are obtained from the IR-sensor, as shown at $t_3$ and $t_4$, will they pass the gate 39; and not until two such pulses in succession are produced will initiation of the ignition circuit take place. The projectile is then certainly close to the target, the pulses from the IR-sensor originate with great probability from a real target and initiation of burst will take place just at the moment when the projectile is oriented with its maximal explosive force directed towards the target.

A number of modifications of the described device are possible within the scope of the invention. Thus, any type of distance measuring device can be used, either measuring the distance continuously or alternatively only indicating the passage of a distance limit. The IR-sensor can also be replaced by any type of detector having sufficiently small lobe angle. The signal processing can be modified in several ways adapted to the construction and location of the sensors and is in practice suitably realized as a program in a microprocessor.

What is claimed is:

1. A device for initiating burst of a projectile which rotates about its length axis and has directive maximum explosive force when the projectile is close to a target, such device comprising:

a first sensor having a narrow sensitivity lobe in a direction oblique to the length axis of the projectile and which is at a predetermined angle with respect to the direction of maximum explosive force of the projectile, such first sensor delivering a pulse-shaped signal signifying target detection each time it is directed towards the target during the rotation of the projectile;

a second sensor adapted to monitor the distance to the target and to deliver a pulse-shaped signal when the projectile has entered a predetermined distance zone from the target, such second sensor having a limited sensitivity lobe in a direction oblique to the length axis of the projectile and which is at a predetermined angle with respect to the sensitivity lobe of the first sensor, the signal produced thereby being phase displaced with respect to the signal produced by the first sensor;

an ignition circuit for igniting the projectile;

a coincidence circuit connected to both sensors for supplying an ignition signal to the ignition circuit to cause it to ignite the projectile in response to concurrent signals from both sensors; and means for comparing the phase of the pulse signals of both sensors and applying them to the coincidence circuit only when such signals are at a predetermined phase relative to each other, whereby only concurrent signals at said predetermined phase can cause the coincidence circuit to supply an ignition signal to the ignition circuit.

2. A device as claimed in claim 1, characterized in that said phase comparison means comprises an AND-circuit a first input of which is supplied with the pulse signal of the first sensor and a second input of which is supplied with the pulse signal of the second sensor; and further comprising a delay circuit connected in series with one of the inputs of said AND-circuit for delaying the pulse signal supplied to such input by a time corresponding to the angle between the sensitivity lobes of the first and second sensors.

3. A device as claimed in either of claims 1 and 2, in which the coincidence circuit comprises counter means adapted to count the number of times the first sensor produces a signal signifying target detection after the signal from the second sensor has indicated that the projectile has entered the predetermined distance zone, such counter means supplying an ignition signal to the ignition circuit to initiate burst only after such counter means has reached a predetermined count.

4. A device as claimed in any one of the claims 1 and 2, characterized in that the narrow sensitivity lobe has substantially the same direction as the direction of maximal explosive force of the projectile.

5. A device as claimed in any one of the claims 1 and 2, characterized in that the first sensor is an IR-detector.

6. A device as claimed in any one of the claims 1 and 2, characterized in that the second sensor is a distance-measuring arrangement of electromagnetic type.

7. A device as claimed in any one of the claims 1 and 2, characterized in that the two sensors are arranged substantially diametrically opposite each other around the length axis of the projectile, so that the signals produced by the two sensors will be substantially 180° phase displaced relative to each other.

* * * * *